United States Patent [19]

Smith et al.

[11] Patent Number: 4,533,136

[45] Date of Patent: Aug. 6, 1985

[54] PEDAL-OPERATED, STATIONARY EXERCISE DEVICE

[75] Inventors: David B. Smith, Mercer Island; Randolph F. Miller, Mount Vernon; John M. Moore, Woodinville, all of Wash.

[73] Assignee: Precor Incorporated, Redmond, Wash.

[21] Appl. No.: 658,531

[22] Filed: Oct. 9, 1984

[51] Int. Cl.[3] ..... A63B 23/04

[52] U.S. Cl. ..... 272/73

[58] Field of Search ..... 272/73, 69; 128/25 R, 128/25 B

[56] References Cited

U.S. PATENT DOCUMENTS

| | | | |
|---|---|---|---|
| 584,989 | 6/1897 | Davis | 72/73 |
| 1,344,963 | 6/1920 | Ruden | 272/73 |
| 2,772,881 | 12/1956 | Fundom | 272/58 |
| 3,467,373 | 9/1969 | Justice | 272/73 |
| 3,945,637 | 3/1976 | Simjian | 272/73 |
| 3,964,742 | 6/1976 | Carnielli | 272/73 |
| 3,995,491 | 12/1976 | Wolfla, III | 73/379 |
| 4,061,460 | 12/1977 | George | 425/459 |
| 4,084,810 | 4/1978 | Forsman | 128/25 R |

FOREIGN PATENT DOCUMENTS

| | | | |
|---|---|---|---|
| 1185846 | 8/1959 | France | 272/73 |
| 1550849 | 12/1968 | France . | |
| 1464540 | 2/1977 | United Kingdom . | |

OTHER PUBLICATIONS

Advertisement illustrating the Monark Ergometer 869; Haden Dynavit Aerobitronic 30; AMF Computrim 900; Tunturi Electronic Ergometer EL 400; Cybex Fitron Cycle Ergometer; and Buick Erobitron exercise bicycles.

Brochure disclosing the Huffy Pulse-Data Model 90501 exercise rowing machine.

Brochure disclosing the Dyna Bike Ergometer by M&R Industries, Inc.

Brochure disclosing the AMF Computrim 900 exercise bicycle.

Brochure illustrating the Cardiotest exercise bicycle by Seca.

Brochure disclosing the Erobitron exercise bicycle by Buick.

Brochure disclosing a Topfit 100 exercise bicycle by Microtec Electronic GmbH.

Brochure disclosing the Haden Dynavit Aerobitronic 30 exercise bicycle.

Brochure illustrating the Ergo-fit 300W and Ergo-fit 200W exercise bicycles.

Brochure disclosing the Heart Mate exercise bicycle by Wimbledon Industries Co.

Brochure disclosing the Bodyguard 955 exercise bicycle.

Brochure disclosing the Lifecycle exercise bicycle by Lifecycle, Inc.

Brochure disclosing the Models ATEL EL400 Electronic Ergometer; ATPT Professional Trainer; ATEE Ergometer; ATHC Home Cycle; and, ATFC Family Cycle exercise bicycles by Tunturi.

(List continued on next page.)

*Primary Examiner*—Richard J. Apley
*Assistant Examiner*—S. R. Crow
*Attorney, Agent, or Firm*—Christensen, O'Connor, Johnson & Kindness

[57] ABSTRACT

A stationary exercise apparatus intended to simulate the action of pedaling a bicycle includes a base and a flywheel mounted on the base for rotation about a vertical axis. The flywheel is coupled in driven relationship to a pair of pedal cranks mounted on the base. The pedal cranks are mounted for rotation about a horizontal axis as in a conventional bicycle. Preferably, the flywheel is mounted directly below the pedals on a shaft whose upper end is formed to be a worm, the worm being driven by a drive gear attached to the pedal cranks. The orientation and location of the flywheel add to the stability of the exercise device as well as aiding in the outward appearance of the device.

7 Claims, 4 Drawing Figures

OTHER PUBLICATIONS

Brochure disclosing the AirDyne Exerciser; ergoMETRIC Exerciser; BIO-DYNE Exerciser; and, Deluxe Exerciser, manufactured by Schwinn.

Brochure disclosing exercise bicycle Models: Sante 1050; Sante 850 and Sante 250 by Pro-Fit Exercisers Canada, Inc.

Brochure disclosing the Monark Electronic Ergometer 869; Ergometer 868; Weight Ergometer 864; Ergometer 865 Monark Mark II; Exercise Cycle 867; Exercise Cycle 872; and, Sparr Rehab 858 exercise bicycles by Monark.

Brochure disclosing the Shape Master 2000; DP Body Shaper; and, Fitness Express exercise bicycles by Diversified Products.

Brochure disclosing the Bodycycle by Marcy Gym Equipment Company.

Brochure disclosing various exercise bicycles set forth in the 1984 Fitness Range brochure from Pan's World, including Models: Folding Cycle III W/Pump PA-301A; Exerciser PA-302; Home Cycle PA-303; Swing Exercise Bike PA-304; Exercise Bike PA-305; and Exerciser PA-306.

50
28
30
34
112
110
108
24b
24
16
14
19
18
12
24a
60
62
46
36
48
42
44
38
56
58
20
66
40
64
22
67
70
71
76
104
52
115
116
96
114
10
80
82
88
90
100
102
95

PEDAL-OPERATED, STATIONARY EXERCISE DEVICE

BACKGROUND OF THE INVENTION

This invention relates to exercise equipment and more specifically relates to exercise equipment that simulates the action of a bicycle but is stationary.

Several types of exercise equipment are currently in use to provide exercise to persons who wish to keep physically fit without venturing out of doors. One of the most popular of the exercise devices has been the stationary exercise bicycle. Early exercise bicycles were very much like real bicyles, except mounted on stands that prevented the wheels from contacting the ground so that the pedaling of the bicycle turned the wheel but did not propel the bicycle. More sophisticated bicycle-simulating equipment has been developed through the years until the exercise bicycles of today, which sometimes do not even resemble standard bicycles and consist primarily of bicycle cranks driven by the feet of the exerciser and drivingly coupled, usually by a chain drive, to a flywheel to provide resistance to the pedal motion, thereby providing the exerciser with a force to work against. Both the appearance and the functional features of exercise bicycles are continuously undergoing change and improvement, however, the typical exercise bicycle still utilizes some sort of a chain-driven wheel, whether it be a lightweight spoked wheel of the true bicycle type or a heavier flywheel, that rotates in a vertical plane about an axis parallel to the axis about which the pedals are moved.

SUMMARY OF THE INVENTION

The present invention provides an exercise device that simulates the action of a bicycle but that is stationary and includes a base upon which is mounted a flywheel rotatable about a first axis, preferably a vertical axis. Bicycle-type cranks are also mounted for rotation on the base, the cranks being rotatable about a second axis orthogonal to the first axis so that the bicycle cranks rotate about a horizontal axis in the typical bicycle fashion. The bicycle-type cranks are drivingly coupled to the flywheel through a drive means. Preferably, the flywheel is mounted directly below the crank to provide stability to the exercise equipment.

In a preferred embodiment of the exercise device of the present invention, the drive means comprises a direct gear drive that does not use a chain. Also, a flywheel-tensioning means is associated with the flywheel and is adjustable to vary the force that must be applied to rotate the flywheel, thereby varying the amount of energy that must be expended by the person exercising in pedaling the cranks in order to turn the flywheel.

BRIEF DESCRIPTION OF THE DRAWINGS

The advantages and features of the present invention will be more easily understood by those of ordinary skill in the art and others upon reading the ensuing specification, taken in conjunction with the appended drawings wherein.

DETAILED DESCRIPTION OF THE PREFERRED EMBODIMENT

Figures 1, 2:
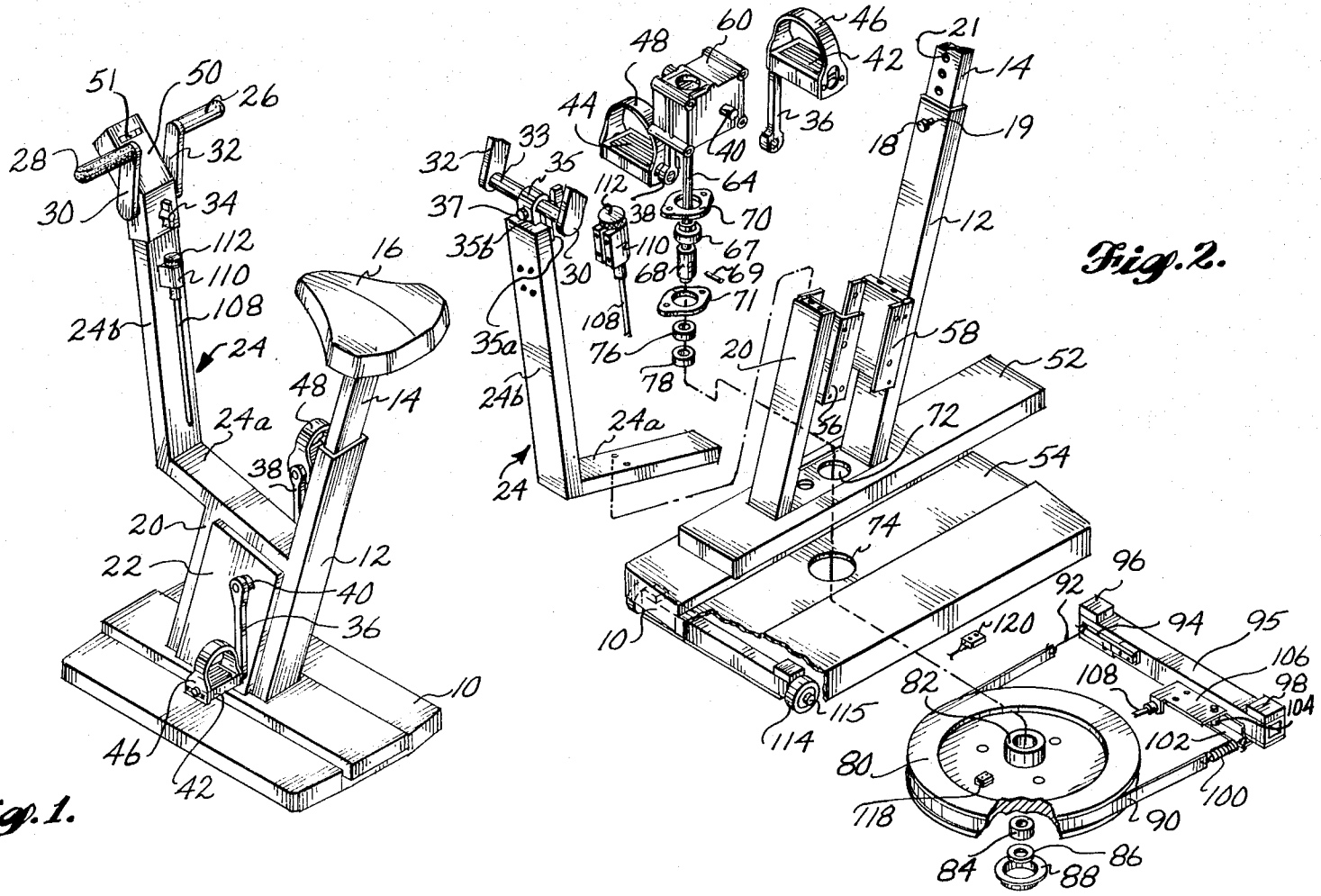
FIG. 1 is an isometric view of one embodiment of an exercise device made in accordance with the principles of the present invention.
FIG. 2 is an exploded isometric view of the exercise device shown in FIG. 1.

FIG. 1 illustrates a preferred embodiment of an exercise device of the cycle type made in accordance with the principles of the present invention. Dealing first with the overall appearance of the exercise device, it can be seen that an essentially rectangular base member 10 supports an upright frame, including a tubular seat support beam 12 having a seat support post 14 slidably fitted within the seat support beam 12. A seat 16 is mounted on the seat support post 14 and the height of the seat relative to the base 10 can be adjusted by moving the seat support post 14 up and down within the support beam 12. The vertical position of the seat 16 is locked in place by a pin 18 spring biased into engagement with one of a series of holes 21 formed in the seat support post. The pin 18 is mounted within a barrel 19 that is affixed to the seat support beam. The pin 18 is spring biased into engagement with the holes in the seat support post. Preferably, the head of pin 18 is formed into a knob that aids in grasping the pin to pull it back against the spring bias when it is desired to change the seat position.

The upright frame further includes a tubular forward support beam 20 spaced from and essentially parallel to the seat support beam 12. The drive mechanism for the exercise device is located in the space between the seat support beam 12 and the forward support beam 20, as will be described in detail later. The drive mechanism is hidden from view when the exercise device is assembled by a facing plate 22 mounted to the seat support beam 12 and forward support beam 20. A handlebar support beam 24 has a first portion **24*a* that is affixed to the seat support beam 12 and extends forwardly and slightly upwardly from the seat support beam 12 over the upper end of the forward support beam 20. A second portion 24*b* of the handlebar support beam 24 extends upwardly to a position of relatively the same height as the seat 16. First and second handle grips 26 and 28 are affixed to respective first ends of handle support members 30 and 32, which in turn, are attached at their respective second ends to a handlebar shaft 33. The handlebar shaft 33 passes through a split cylindrical clamp member 35 that is affixed to the upper end of the handlebar support beam 24. Clamp member 35 has a mounting tab 35*a* that is affixed to the handlebar support beam 24 and a clamping tab 35*b* that is spaced from the mounting tab. A bolt 37 passes through the tabs 35*a* and 35*b* and is engaged by a wing nut 34. Tightening the wing nut on the bolt 37 draws the tabs toward one another and clamps the handlebar shaft 33 in place. The orientation of the handle grips 28 and 26 on the handlebar support beam 24 can be adjusted by loosening the wing nut 34 to unclamp the shaft 33**.

First and second pedal cranks 36 and 38, respectivey, are attached at their first ends to opposite ends of a pedal shaft 40 that extends from the drive mechanism through the facing plate 22 and a corresponding facing plate that is not shown but is located on the opposite side of the upright frame. Conventional pedals 42 and 44 are attached to the second ends of the respective pedal cranks and conventional toe straps 46 and 48 are associated with the pedals. Preferably, the cycle includes a means of measuring progress on the exercise cycle. The monitor and control panel 50 mounted on the handlebar support beam 24 contains a microprocessor that receives signals from devices to be described later related to speed of the flywheel and work done by the cycler. The panel 50 includes readouts such as indicator 51 that indicate to the user the speed and work expended parameters.

Figure 3:
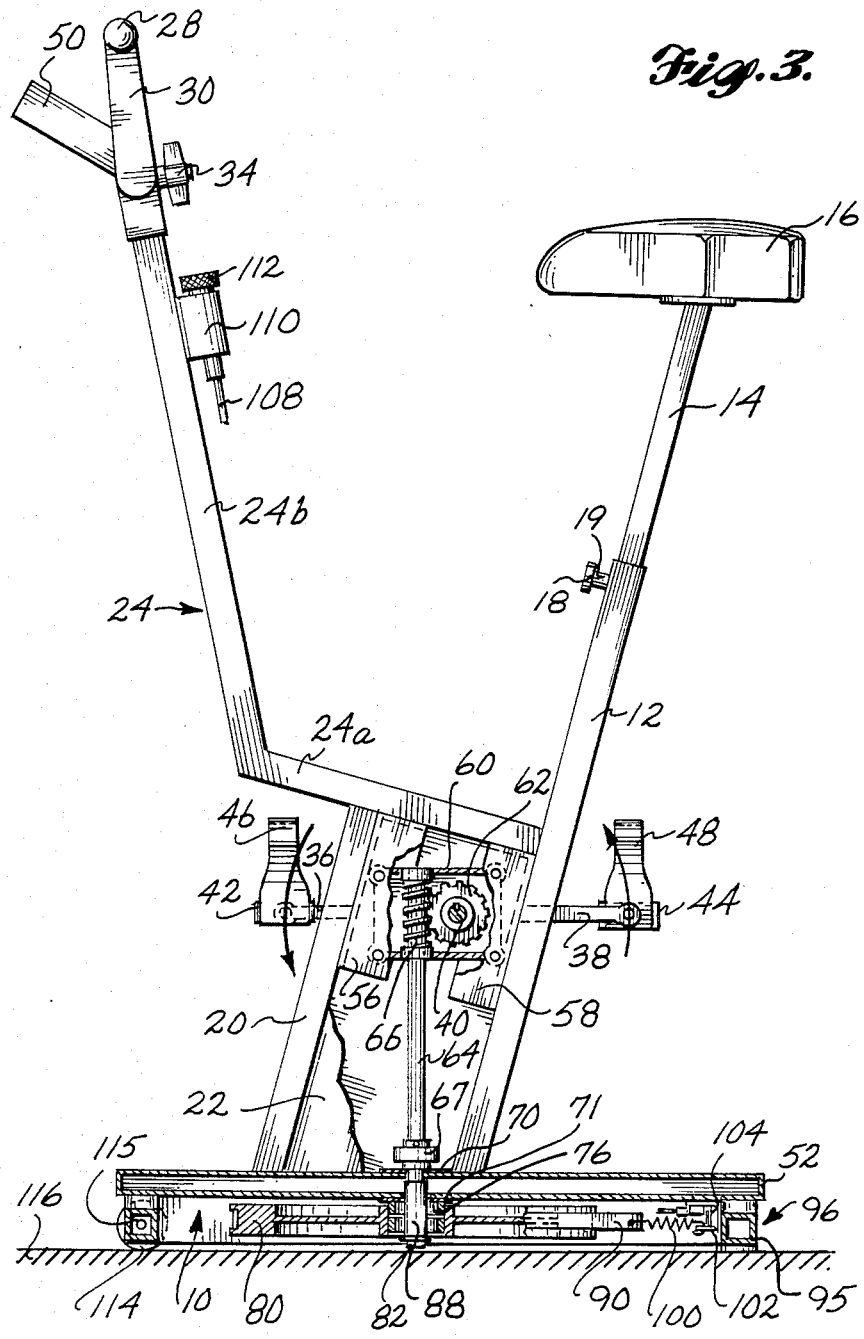
FIG. 3 is a side elevational view of the exercise device shown in FIGS. 1 and 2 with portions cut away to expose the drive mechanism.

Referring now to FIGS. 2 and 3, it can be seen that the seat support beam 12 and forward beam 20 are affixed at first ends thereof to a base beam 52 that is essentially rectangular in shape and fits within a similarly shaped channel 54 formed in an upper wall of the base 10. A pair of bracket members 56 and 58, respectively, are mounted in diametrical opposition on facing surfaces of the seat support beam 12 and forward support beam 20 and provide a mount for a gearbox 60, which contains the drive mechanism for the exercise device. The drive mechanism includes pedal shaft 40, which is journalled within the walls of the gearbox 60 and has a drive gear 62 affixed to it so that the drive gear 62 turns in response to pedaling action exerted on the pedal cranks 36 and 38. A vertical drive shaft 64 passes through the lower wall of the gearbox 60 and is mounted in a bearing press fit into the upper wall of the gearbox 60. An upper portion of the drive shaft 64 is formed to be a worm 66 and the drive gear 62 drivingly engages the worm 66 so as to turn the drive shaft 64 in response to pedaling of the exercise device. The drive shaft 64 passes through an opening 72 in the base beam 52. The shaft is radially centered in the opening by a bearing 67. The bearing 67 is held in place by upper and lower retaining rings 70 and 71 bolted to the beam 52. The lower portion of the drive shaft 64 has a hardened sleeve 68 mounted on it and affixed to the shaft by a roll pin 69 that passes through the sleeve and is press fit into the shaft. A flywheel 80 is horizontally positioned within the base 10 and a pair of one-way clutch bearings 76 and 78 are press fit within a hub 82 of the flywheel. The sleeve 68 is disposed within the bearings 76 and 78 and the bearings 76 and 78 operate such that their rollers lock up against the sleeve 68 when shaft 64 is rotating due to pedalling action to drive the flywheel 80. The bearing rollers rotate freely against the sleeve 68 when the flywheel is freewheeling. Suitable clutch bearings have been found to be Torrington clutch bearings #RC 162110 available from the Torrington Company, Torrington, Conn. A ball bearing 84 is disposed within a counterbore formed in the bottom of hub 82. A snap ring 86 engages a groove formed in the shaft 64 and bears against the inner race of the ball bearing 84 to vertically support the flywheel 80 on the shaft. The bearing 86 radially centers the shaft within the hub 82 when the flywheel is freewheeling. A dust cap 88 covers the lower end of the shaft 64 and the bearing 84.

Since the flywheel 80 is driven directly by the pedals without a chain or belt the pedal action of the cycle is very smooth. In the preferred embodiment the drive gear arrangement is a gear box produced by the Morse Company with the designation ED-13 as a speed reducer. In the exercise cycle the gear box is used as a speed increaser with the worm acting as the output shaft. The preferred gear ratio is 7.5 to 1. Since the input and output functions of the worm 66 and drive gear 62 are reversed from their normal mode of operation, it is necessary to cut the gear teeth differently so the drive gear 62 function efficiently as a drive gear instead of a driven gear.

The flywheel 80 is designed to provide the rider with the feel of riding a real bicycle. The preferred flywheel is 25 pounds and has an outer diameter of 14 inches. The flywheel is one inch thick and approximates the momentum of a moving bicycle and rider. The flywheel is machined and balanced to provide smooth performance of the drive system and to prevent jerky motion between high-torque pedal position, that is, when the pedals are horizontally level with one another, and low-torque pedal position, that is, when one pedal is in its uppermost position and the other pedal is in its lowermost position.

Figure 4:
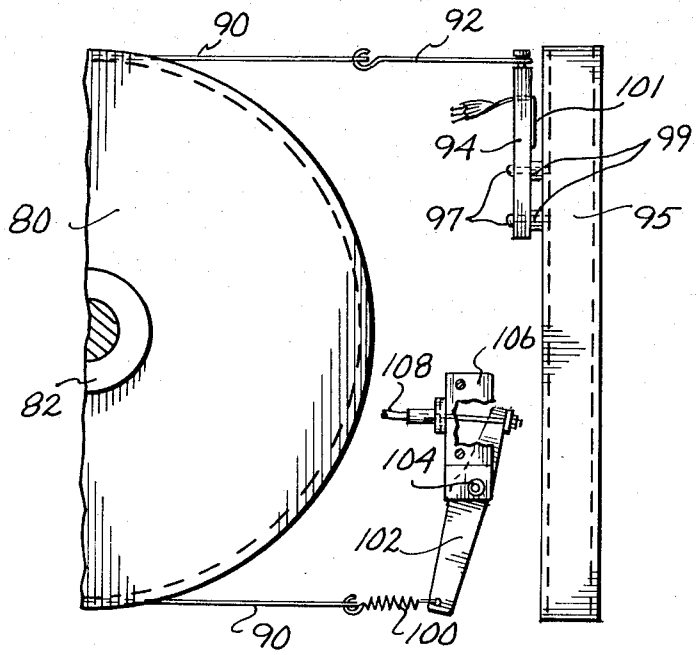
FIG. 4 is a bottom elevational view of a portion of the exercise device of FIG. 1.

In order to vary the amount of force necessary to turn the flywheel, a tensioning mechanism is provided to apply a frictional force on the periphery of the flywheel. As best viewed in FIGS. 2 and 4, a friction band 90 is attached at a first end thereof by an inextensible wire 92 to one end of a band support beam 94 mounted on a foot 95 that is transversely mounted along the back of the base 10. The foot 95 is spaced from the upper wall of the base by spacers 96 and 98, respectively. The beam 94 is fastened to the foot 95 by fasteners 97 located adjacent one end of the beam opposite the attachment point of wire 92 and is spaced from the beam 95 by spacer washers 99. In this way the beam is cantilevered on the foot and can bend slightly under the tension of the band. A load cell 101 (strain gauge) is affixed by epoxy to the beam to measure the distortion of the beam. The load cell sends signals to the microprocessor in the control panel 50 in response to the beam distortion.

The friction band 90 fits in a shallow groove formed around the periphery of the flywheel 80 and a second end of the friction band 90 is attached to one end of an extension spring 100. The other end of the spring 100 is attached to a first end of a tension bar 102 spaced from the foot 95. The tension bar 102 is pivotally mounted for swinging movement about a pin 104 affixed to a plate 106 that, in turn, is affixed to the undersurface of the top wall of the base 10. The second end of the tension bar 102 is visible in FIG. 4 and is attached to a first end of a push-pull adjustment cable 108. The second end of the push-pull adjustment cable 108 is mounted in a support bracket 110, which, in turn, is affixed to the handlebar support post **24*b*. A friction adjuster knob 112 is attached to the second end of the push-pull adjustment cable 108 and threadably engages the bracket 110. By turning the knob 112, the knob shaft moves upwardly or downwardly with respect to the bracket 110 carrying with it the second end of the cable 108. The cable 108 is a stiff but flexible push-pull control cable, such as a Bowden wire, and the movement of the second end in response to movement of the knob 112 results in a fore-/aft movement of the first end of the control cable, which, in turn, causes a corresponding forward-and-aft movement of the second end of the bar 102, thereby pivoting the bar about pin 104. As the bar 102 pivots about pin 104, the extension of the spring 100 varies, which, in turn, increases or decreases the tension that the spring 100 exerts on the friction band 90 on the outer periphery of the flywheel 80. Increasing the tension of the spring increases the frictional force exerted by the band 90 on the flywheel 80 and increases the amount of energy that must be exerted on the pedals to turn the flywheel. Conversely, decreasing the spring tension decreases the friction on the flywheel and decreases the amount of energy that must be expended to turn the flywheel. In this manner, the amount of energy necessary to be exerted on the pedals to turn the flywheel can be varied for different users of the exercise equipment. The energy expended to turn the flywheel can be calculated by the microprocessor using the signals it receives from the load cell on beam 94**.

As can be seen in FIGS. 2 and 3, the forward end of the base 10 has a set of rollers 114 rotatably mounted thereon. The rollers provide means by which the exercise bike can be moved across a floor 116. The user simply lifts the rear end of the exercise bike by exerting an upward force on the seat and then rolls the exercise bike on the rollers 114 rotatably mounted on axles 115 located at the forward end of the base.

The microprocessor also receives input related to the speed of rotation of the flywheel 80. A magnet 118 is mounted on the upper surface of flywheel 80. A corresponding magnetic sensor 120 is mounted on the underside of the base 10 and monitors the frequency with which the magnet 118 passes. This information is provided to the microprocessor and combined with time information produced by the microprocessor clock to calculate speed of the cycle. The speed data, time data, and energy data from the load cell 101 permit the microprocessor to provide information as to calories per unit time expended by a user of the cycle.

By placing the flywheeel 80 in a horizontal orientation, it is possible to mount the flywheel in the base of the exercise bike, rather than in a forward position as in the typical exercise bicycle. Mounting the flywheel in the base allows for a more streamlined and cleaner aesthetic appearance to the cycle, while contributing to the stability of the cycle by sheer weight of the flywheel at the base, combined with a gyroscopic stabilizing motion caused by rotation of the flywheel in the base. Therefore, while most conventional exercise bicycle devices are arranged so that the axis of rotation of the pedals and the axis of rotation of the flywheel driven by the pedals are parallel, the exercise device of the present invention provides an exercise cycle in which the axis of rotation of the pedals is substantially orthogonal to the axis of rotation of the flywheel. Preferably, the rotation of the pedals is about a horizontal axis, while the rotation of the flywheel is about a vertical axis.

While a preferred embodiment of the present invention has been described and illustrated, it will be understood by those of ordinary skill in the art and others that certain modifications can be made to the illustrated embodiment while remaining within the scope of the present invention. Therefore, the present invention should be defined solely with reference to the appended claims.

The embodiments of the invention in which an exclusive property or privilege is claimed are defined as follows:

1. A stationary exercise apparatus comprising:

(a) a base;

(b) a flywheel rotatably mounted on said base for rotation about a first axis;

(c) first and second pedal cranks mounted on said base for rotation about a common second axis, said second axis substantially orthogonal to said first axis;

(d) drive means associated with said base drivingly coupling said pedal cranks to said flywheel, said drive means including:

a pedal shaft, said first and second pedal cranks fixed on, respectively, first and second ends of said pedal shaft;

a drive gear fixed to said pedal shaft for rotation in unison with said pedal shaft;

a driven gear drivingly engaged by said drive gear, said driven gear being directly coupled to said flywheel to drive said flywheel in response to rotation of said pedal cranks; and wherein said drive gear is a worm gear and said driven gear is a worm;

(e) a flywheel shaft, said worm being formed in a first portion of said flywheel shaft; and, (f) a clutch means associated with said flywheel and engaging a second portion of said flywheel shaft to drivingly couple said flywheel shaft to said flywheel.

2. The exercise apparatus of claim 1, wherein said clutch means is a one-way clutch that is operable to drivingly couple said flywheel to said flywheel shaft when said pedal cranks rotate in a first direction, but allows said flywheel to freewheel on said shaft when said pedal cranks cease rotation.

3. A stationary exercise apparatus comprising:

(a) a base;

(b) a flywheel rotatably mounted on said base for rotation about a substantially vertical first axis;

(c) first and second pedal cranks mounted on said base for rotation about a common second axis, said second axis substantially orthogonal to said first axis;

(d) drive means associated with said base drivingly coupling said pedal cranks to said flywheel, said drive means including:

a pedal shaft, said pedal cranks being mounted, respectively, to a first and second end of said pedal shaft;

a first gear affixed to said pedal shaft for rotation in unison with said pedal shaft;

a second gear coupled in driven relationship to said first gear for rotation of said second gear about a vertical axis, said second gear being drivingly coupled to said flywheel; and, wherein said first gear is a worm gear and said second gear is a worm; and, (e) further including flywheel friction means associated with said flywheel, said friction means being adjustably operable to vary the force necessary to be exerted on the pedal cranks in order to obtain rotation of said flywheel.

4. The exercise apparatus of claim 3, further including a one-way clutch associated with said flywheel and said worm such that rotation of said pedal cranks in a first direction results in rotation of said flywheel while rotation of said pedal cranks in a second, opposing direction results in no motion of said flywheel.

5. A stationary exercise apparatus comprising:

a base;

a flywheel rotatably mounted on said base for rotation about a substantially vertical first axis;

a first and second pedal cranks mounted on said base for rotation about a common second axis, said second axis substantially orthogonal to said first axis;

drive means associated with said base drivingly coupling said pedal cranks to said flywheel; and, flywheel friction means associated with said flywheel, adjustably operable to vary the force necessary to be exerted on the pedal cranks in order to obtain rotation of said flywheel, said flywheel friction means includes a friction band adjustably engaging the outer periphery of said flywheel to exert a force on said flywheel opposing rotation of said flywheel.

6. The exercise apparatus of claim 5, further including a load cell associated with said friction band and operable to produce a first signal related to the tension of said friction band.

7. The exercise apparatus of claim 6, wherein a first end of said band is attached to a first end of a beam, said beam being affixed at a second end to said base, said beam bending in varying amounts related to the tension of said band and further including a strain gauge affixed to said beam to produce a signal related to the magnitude of bend in said beam.

* * * * *